US008287179B2

(12) United States Patent
Miyamoto et al.

(10) Patent No.: US 8,287,179 B2
(45) Date of Patent: Oct. 16, 2012

(54) FLUID MIXER

(75) Inventors: Tetsuro Miyamoto, Kasumigaura (JP); Yoshishige Endo, Tsuchiura (JP); Shigenori Togashi, Abiko (JP); Erika Katayama, Mito (JP)

(73) Assignee: Hitachi Plant Technologies, Ltd., Tokyo (JP)

( * ) Notice: Subject to any disclaimer, the term of this patent is extended or adjusted under 35 U.S.C. 154(b) by 310 days.

(21) Appl. No.: 12/708,070

(22) Filed: Feb. 18, 2010

(65) Prior Publication Data

US 2010/0265786 A1 Oct. 21, 2010

(30) Foreign Application Priority Data

Apr. 16, 2009 (JP) ..... 2009-099514

(51) Int. Cl.
*B01F 5/04* (2006.01)

(52) U.S. Cl. ..... 366/178.2; 366/178.1

(58) Field of Classification Search ..... 366/178.1, 366/178.2

See application file for complete search history.

(56) References Cited

U.S. PATENT DOCUMENTS

| | | | | |
|---|---|---|---|---|
| 2,965,362 | A * | 12/1960 | Flottmann et al. | 366/169.1 |
| 3,540,474 | A | 11/1970 | Sharples | |
| 5,857,773 | A * | 1/1999 | Tammelin | 366/178.1 |
| 5,935,490 | A | 8/1999 | Archbold | |
| 7,579,191 | B2 | 8/2009 | Nagasawa et al. | |
| 2004/0052158 | A1 | 3/2004 | Holl | |
| 2007/0291581 | A1 | 12/2007 | Ehrfeld et al. | |
| 2008/0078446 | A1 | 4/2008 | Fujiwara | |

FOREIGN PATENT DOCUMENTS

| | | |
|---|---|---|
| EP | 1 762 298 A1 | 3/2007 |
| GB | 15774 | 0/1914 |
| JP | 2005-288254 | 10/2005 |
| WO | WO 2006/018644 | 2/2006 |

OTHER PUBLICATIONS

EP Search Report dated Oct. 7, 2010 in English.

* cited by examiner

*Primary Examiner* — David Sorkin
(74) *Attorney, Agent, or Firm* — Antonelli, Terry, Stout & Kraus, LLP.

(57) ABSTRACT

A fluid mixer for mixing a first fluid and a second fluid includes an introducing component having a bore, a cylindrical component fitted into the bore of the introducing component and a mixing component having a conical recess and on which the introducing component and the cylindrical component are held. A first introducing flow path receives the first fluid and a first distributing flow path distributes the first fluid over the whole circumference of the cylindrical component. A second introducing flow path receives the second fluid. A second distributing flow path distributes the second fluid so that the first fluid and the second fluid are alternately arranged in an circumferential direction. A joining part joins together the first fluid and the second fluid fed with the fluids alternately arranged circumferentially.

7 Claims, 7 Drawing Sheets

FLUID MIXER

BACKGROUND OF THE INVENTION

The present invention relates to a fluid mixer capable of performing a process of mixing and chemical reactions of fluid such as liquid or gas on a scale of less than 1 mm in width of a flow path.

In recent years, in a chemical synthesis or chemical analysis field, fluid mixers have been used which are made up of a flow path of several tens to several hundred μm manufactured by microfabrication technology with the aim of shortening time for mixing and reactions. The fluid mixers of this kind are called micro mixers or micro reactors.

The micro mixer has a short characteristic length of a flow path and a small Reynolds number which is a non-dimensional number indicating a ratio between inertial force and viscous force in a fluid and, therefore, flow becomes a layer stream. As a result, when various kinds of fluids are mixed, the mixing progresses mainly by molecular dispersion. By shortening a characteristic length of a flow path, dispersion distance is reduced, which enables rapid mixing and highly efficient chemical reactions.

EP 1762298 A1 discloses a micro reactor in which a plurality of nozzles for two different fluids are arranged on a circumference to form multilayer streams of which the two fluids alternately flow and widths of the multilayer streams are reduced towards downstream, namely, a center of the reactor.

By using the micro reactor having such characteristics as described above, production of homogeneous particles by reactions between fluids has been attempted.

U.S. Pat. No. 7,579,191 discloses a structure in which fluid not contributory to reactions is placed between an internal wall of a micro reactor and a reaction fluid to produce particles.

U.S Patent Publication No. 2007-0291581 discloses a structure in which a check-valve is provided between an introducing flow path of a reaction fluid and a portion for fluid joining and mixing.

Purposes to produce particles by using a micro reactor are various but one of the purposes is to produce high-quality particles by uniformly controlling conditions for reactions for producing particles to rapidly mix a plurality of fluids.

In the micro reactor disclosed in EP 1762298 A1, rapid mixing is achieved by gradually narrowing flow paths configured to mix fluids, however, this micro reactor has a problem in that clogging easily occurs due to produced particles in the portion where the fluid-mixing flow paths are gradually narrowed.

Also, the micro reactor disclosed in U.S. Pat. No. 7,579,191 has also a problem in that, though adhesion of produced particles can be suppressed, due to mixing of fluids not contributory to reactions, control on uniform reactions is difficult.

Additionally, the micro reactors disclosed in U.S. Pat. No. 7,579,191 and U.S Patent Publication No. 2007-0291581 are configured to perform mixing by reducing a characteristic length of the flow paths for mixing fluids, a shape to be divided and/or dimensions to shorten a mixing distance. Therefore, there is also a problem that mixing efficiency depends on dimensions of the flow path and the improvement of mixing speed without being limited by dimensions of the flow path is difficult.

SUMMARY OF THE INVENTION

In view of the above-described problems, the present invention is invented and it is an object of the present invention to rapidly mix fluids and to avoid clogging of a flow path caused by particles produced through the mixing process of fluids.

According to a first aspect of the present invention, there is provided a fluid mixer for mixing, at least, a first fluid and a second fluid and comprising: an introducing component having a bore; a cylindrical component inserted into the bore of said introducing component and comprising a cylindrical section and a conical section projecting from a bottom of the cylindrical section; and a mixing component having a conical recess and on which said introducing component and said cylindrical component are held, said fluid mixer further comprising: a first introducing flow path into which the first fluid is introduced; a first distributing flow path to distribute the first fluid introduced from said first introducing flow path over whole circumference of said cylindrical component; a second introducing flow path into which the second fluid is introduced; a second distributing flow path of an annular shape concentric with said cylindrical component and for distributing the second fluid introduced from said second introducing flow path so that the first fluid and the second fluid are alternately arranged in an circumferential direction; a joining part in which the first fluid fed from said first distributing flow path and the second fluid fed from said second distributing flow path join together; a mixing flow path formed between said conical section of the cylindrical component and said conical recess of said mixing component and for mixing the first and second fluids, said mixing flow path having a cross sectional area in a direction perpendicular to a gravity direction becoming constant or larger towards downstream of the first and second fluids; and a discharge flow path to discharge mixed fluid of the first and second fluids fed from said mixing flow path.

The first introducing flow path is provided in the introducing component, the first distributing flow path is provided in the cylindrical component, and the second introducing flow path, the joining part, the mixing flow path and the discharge flow path are provided in the mixing component.

The second distributing flow path distributes the second fluid so that the width of the second fluid becomes substantially the same as that of the first fluid.

The second distributing flow path distributes the second fluid so that the number of the widths of the second fluid becomes the same as that of the first fluid.

A cross sectional area of said joining part in a direction substantially perpendicular to a gravity direction may be nearly equal to that of the discharge flow path.

The cylindrical component is provided with a first supplying flow path through which the first fluid flows and wherein a length of a diameter of a portion of the cylindrical component in which the first supplying flow path is provided is longer than a length of a diameter of a portion of the cylindrical component in which the first distributing flow path is provided.

The fluid mixer may further comprise an introducing component plate provided between the introducing component and the mixing component and wherein the mixing component is provided with a third introducing flow path through which third fluid is introduced and a third distributing flow path for distributing the third fluid introduced from the third introducing flow path so that the fluids are arranged in order of the first fluid, the second fluid, and the third fluid, the third distributing flow path being positioned in a manner concentric with respect to the cylindrical component and being provided at a position more apart from the center of the cylindrical component than a position where the second fluid is distributed by the second distributing flow path.

The second distributing flow path and the third distributing flow path distribute the second fluid and the third fluid so that lengths of widths of the first fluid, the second fluid and the third fluid become approximately the same as each other.

The second distributing flow path and the third distributing flow path distribute the second fluid and the third fluid so that numbers of the widths of the first fluid, the second fluid and the third fluid are same as each other.

According to a second aspect of the invention, there is provided a fluid mixer comprising an introducing component, a cylindrical component fitted into said introducing component and comprising a cylindrical section and a conical section, and a mixing component on which said introducing component and said cylindrical component are fixed and for mixing, at least, first fluid and second fluid, wherein said introducing component is provided with a first introducing flow path through which the first fluid is introduced, wherein said cylindrical component is provided with a first distributing flow path to distribute the introduced first fluid to whole circumference of said cylindrical component, wherein, said mixing component is provided with a second introducing flow path into which the second fluid is introduced, a second distributing flow path concentric with respect to said cylindrical component and to distribute the second fluid so that the first fluid and the second fluid are alternatively arranged, a joining part in which the first and second fluids join together, a mixing flow path formed in a space between said conical section and said mixing component and for mixing the first and second fluids from said joining part and having cross sectional area in a direction perpendicular to a gravity direction becoming larger towards downstream of the fluids, and a discharge flow path to discharge the mixed first and second fluids.

With the above configuration, it is possible to rapidly mix fluids and to avoid clogging of a flow path caused by particles produced through the mixing process of fluids.

Other objects, features and advantages of the invention will become apparent from the following description of the embodiments of the invention taken in conjunction with the accompanying drawings.

DETAILED DESCRIPTION OF THE INVENTION

Figure 1:
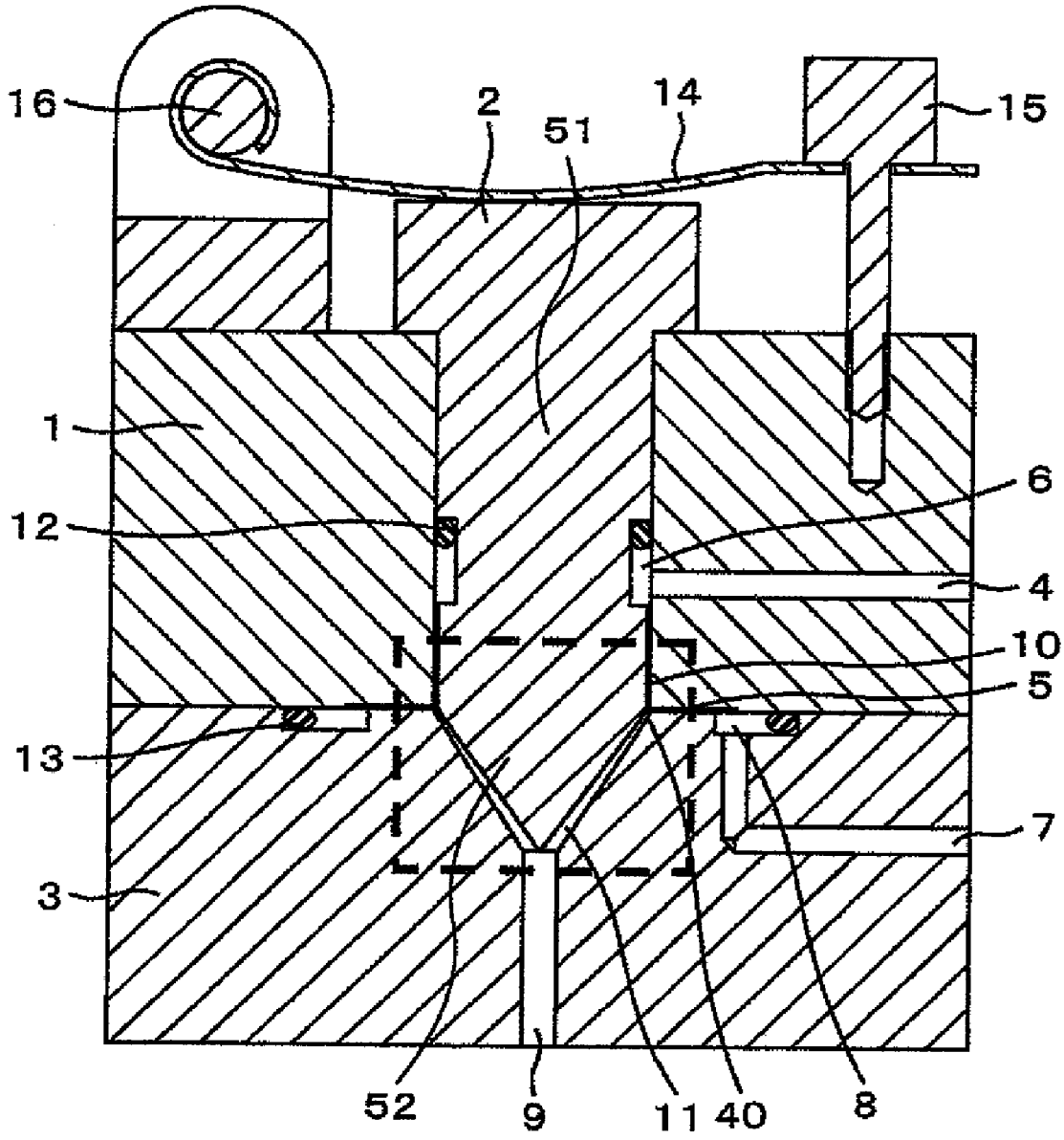
FIG. 1 is a cross-sectional view of a first embodiment of a fluid mixer according to the present invention.

A first embodiment of a fluid mixer of the present invention will be described with reference to FIGS. 1 to 5.

A first embodiment of a fluid mixer comprises at least three components including an introducing component 1 having a bore, a cylindrical component 2 inserted into the bore of the introducing component 1 and comprises a cylindrical section 51 and a conical section 52 projecting from a bottom of the cylindrical section 51, and a mixing component 3 on which the introducing component 1 and cylindrical component 2 are fixed.

Figure 3:
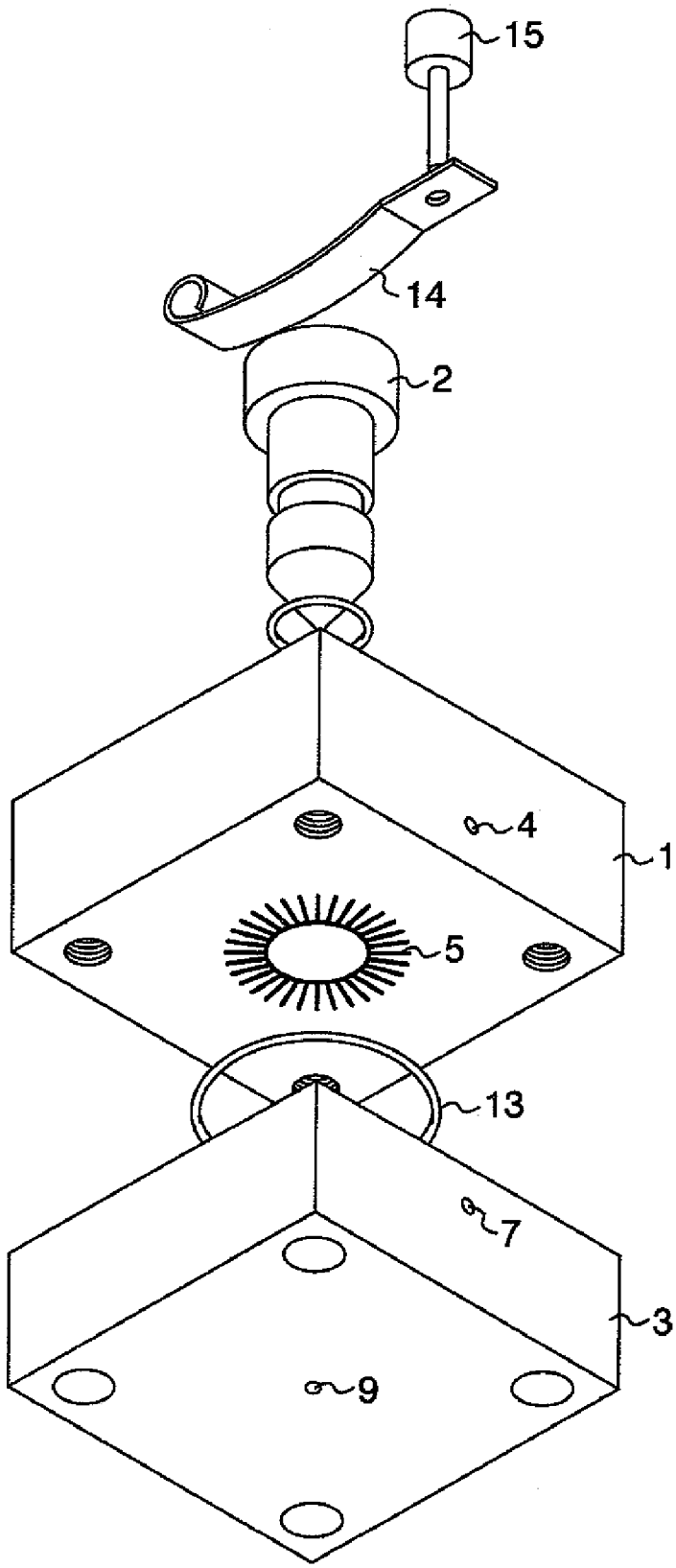
FIG. 3 is an exploded perspective view of the first embodiment of the fluid mixer as seen from below.

The introducing component 1 is provided with a first introducing flow path 4 and a second supplying flow path 5 as shown in FIG. 3. The second supplying flow path 5 comprises a plurality of radially extending flow passages outlets of which are opened in the bore of the introducing component 1 and inlets of which are opened in a second distributing flow path 8 which is described later. The outlets of the radially extending flow passages of the second supplying flow path 5 have a width which is substantially identical with a distance between adjacent radially extending flow passages.

The cylindrical component 2 is provided with a first distributing flow path 6. The first distributing flow path 6 comprises an annular recess formed around the cylindrical component 2.

Figure 2:
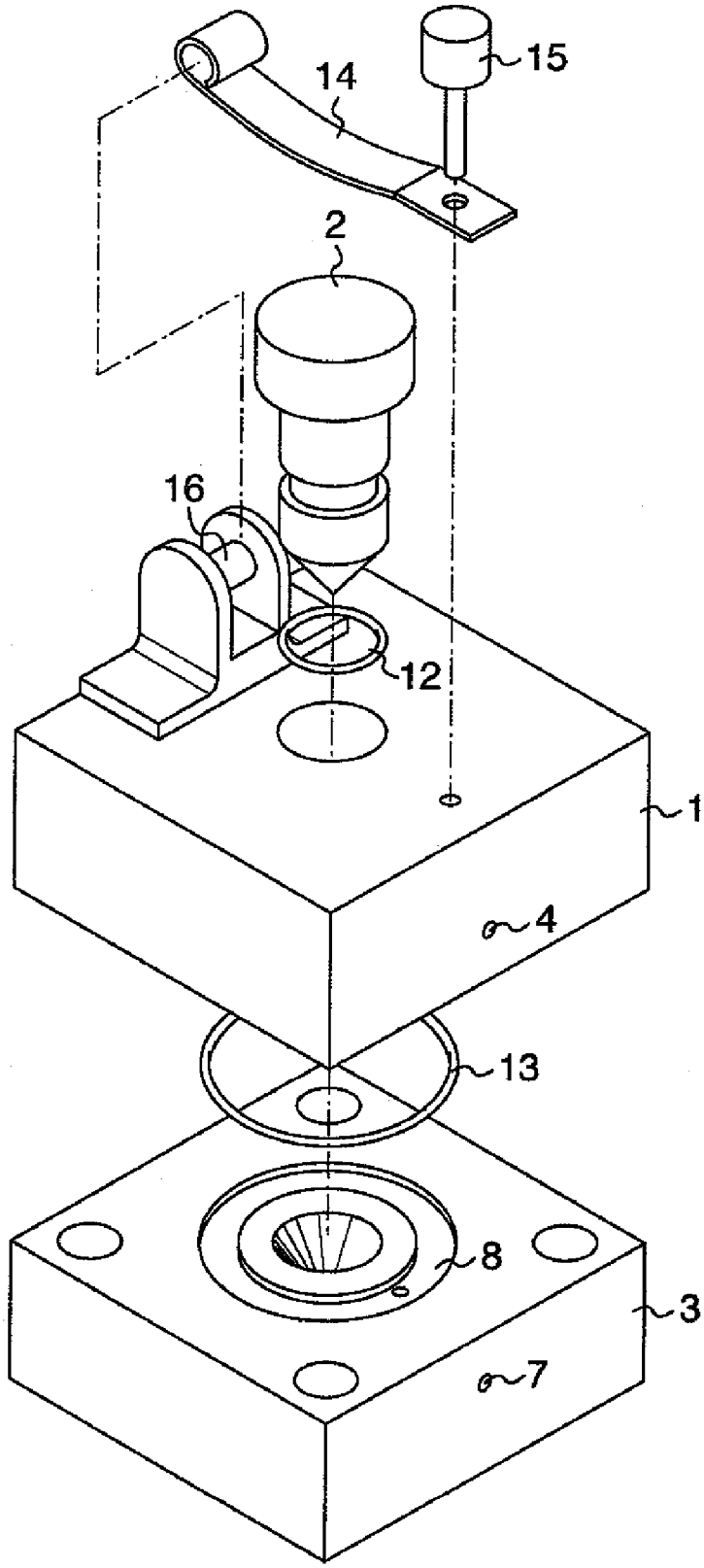
FIG. 2 is an exploded perspective view of the first embodiment of the fluid mixer as seen from above.

The mixing component 3 is provided with a second introducing flow path 7, the second distributing flow path 8, and a discharge flow path 9 to discharge mixed fluid to a container or the like. The second introducing flow path 7 is communicated with the second distributing flow path 8. The second distributing flow path 8 comprises an annular recess formed on the mixing component 3 as shown in FIG. 2. The second distributing flow path 8 functions as a temporary pool for second fluid introduced from the second introducing flow path 7 and equally distributes the second fluid into the radially extending flow passages of the second supplying flow path 5.

O-rings 12 and 13 are respectively arranged in the first distributing flow path 6 and the second distributing flow path 8.

The first introducing flow path 4 is communicated with the first distributing flow path 6. The first distributing flow path 6 functions as a temporary pool for first fluid introduced from the first introducing flow path 4 and uniformly distributes the first fluid into a first supplying flow path 10 (described later).

The first distributing flow path 6 is formed by a circular clearance between the bore of the introducing component 1 and the cylindrical section 51 of the cylindrical component 2 which occurs by constructing a portion of the cylindrical section 51 corresponding to the first distributing flow path 6 so as to have a smaller diameter than the other portions of the cylindrical section 51. A diameter of the cylindrical section 51 of the cylindrical component 2 positioned above the first distributing flow path 6 is approximately the same as an internal diameter of the bore of the introducing component 1. A center of an axis of the cylindrical section 51 of the cylindrical component 2 positioned below the first distributing flow path 6 is the same as a center of an axis of the cylindrical section 51 of the cylindrical component 2 positioned above the first distributing flow path 6 and a diameter of the cylindrical section 51 of the cylindrical component 2 positioned below the first distributing flow path 6 is slightly smaller than that of the cylindrical section 51 of the cylindrical component 2 above the first distributing flow path 6. Moreover, a diameter of the bore of the introducing component 1 is approximately the same length as in its upper and lower portions. Accordingly, the first annular supplying flow path 10 extending downwardly from the first distributing flow path 6 is formed between the introducing component 1 and the cylindrical section 51 of the cylindrical component 2 positioned below the first distributing flow path 6, due to a difference in diameter of the cylindrical component 2. That is, the diameter of a portion of the cylindrical component 2 in which a first fluid flows is made to be longer than that of a portion of the cylindrical component 2 in which the first distributing flow path 6 is formed and is made to be shorter than the diameter of a portion of the cylindrical component 2 in a direction opposite to a gravity direction from the portion of the cylindrical component 2 in which the first distributing flow path 6 is formed. With the above-mentioned structure, it becomes possible to make the first supplying flow path 10 be an annular flow path having an uniform thickness of several tens to several hundred μm, which can provide an equal flow field of a fluid by the whole circumference.

A conical recess is formed in the mixing component 3 and the conical recess has a conical angle smaller than that of the conical section 52 of the cylindrical component 2. The conical section 52 extends in the conical recess of the mixing component 3 and a mixing path 11 is formed between the conical recess and the conical section 52 of the cylindrical component 2.

The cylindrical component 2 is fixed to the introducing component 1 by a cylinder retainer 14, a fixing screw 15, and a supporting member 16.

Then, mixing and reaction process in the first embodiment of the fluid mixer will be described.

First fluid introduced from the first introducing flow path 4 is distributed by the first distributing flow path 6 over whole circumference of the cylindrical component 2 and then passes through the first supplying flow path 10. Similarly, second fluid introduced from the second introducing flow path 7 is distributed by the second distributing flow path 8 in a concentric manner with respect to the whole circumference of the cylindrical component 2 and passes through the second supplying flow path 5. The first fluid and the second fluid join together at a joining part 40 and then are introduced into the mixing flow path 11.

Figure 4:
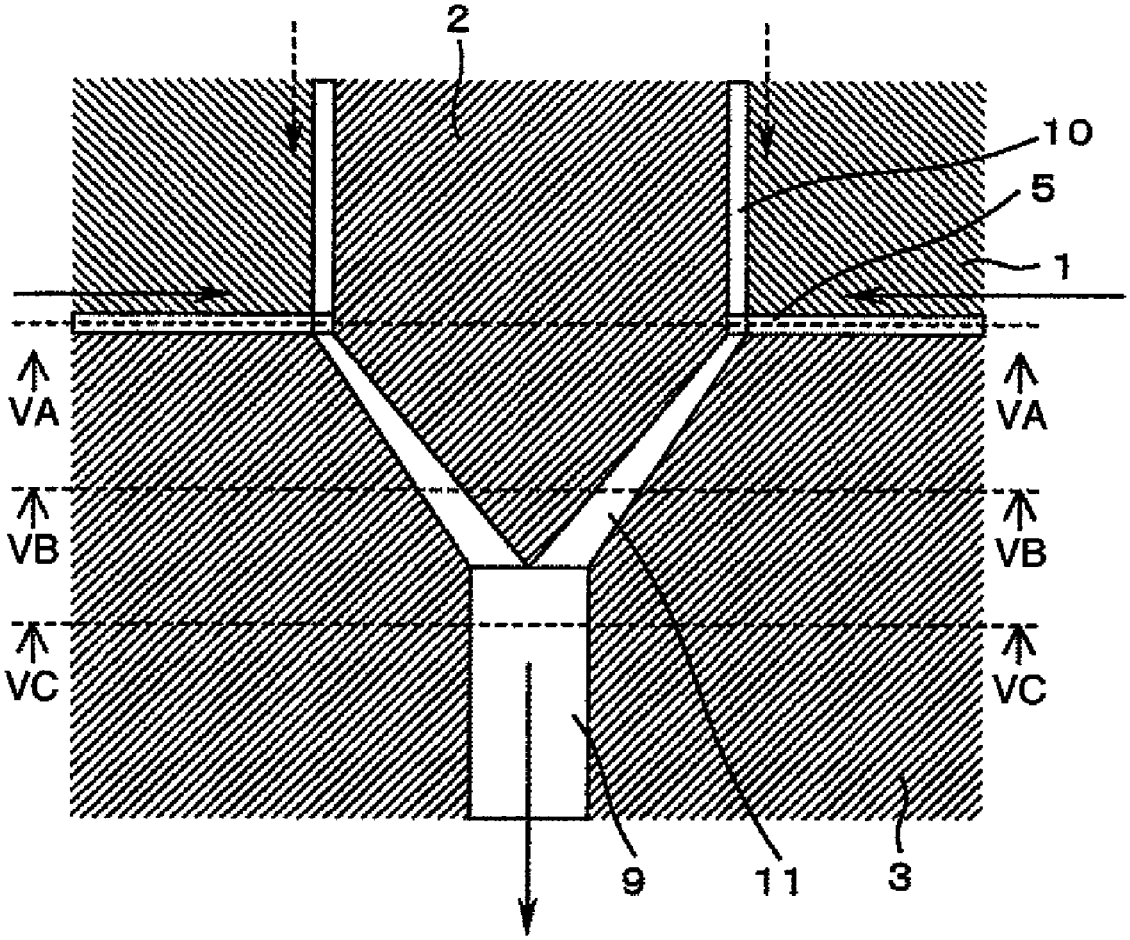
FIG. 4 is an enlarged view of a portion surrounded by a dotted line in FIG. 1.
Figure 5A:
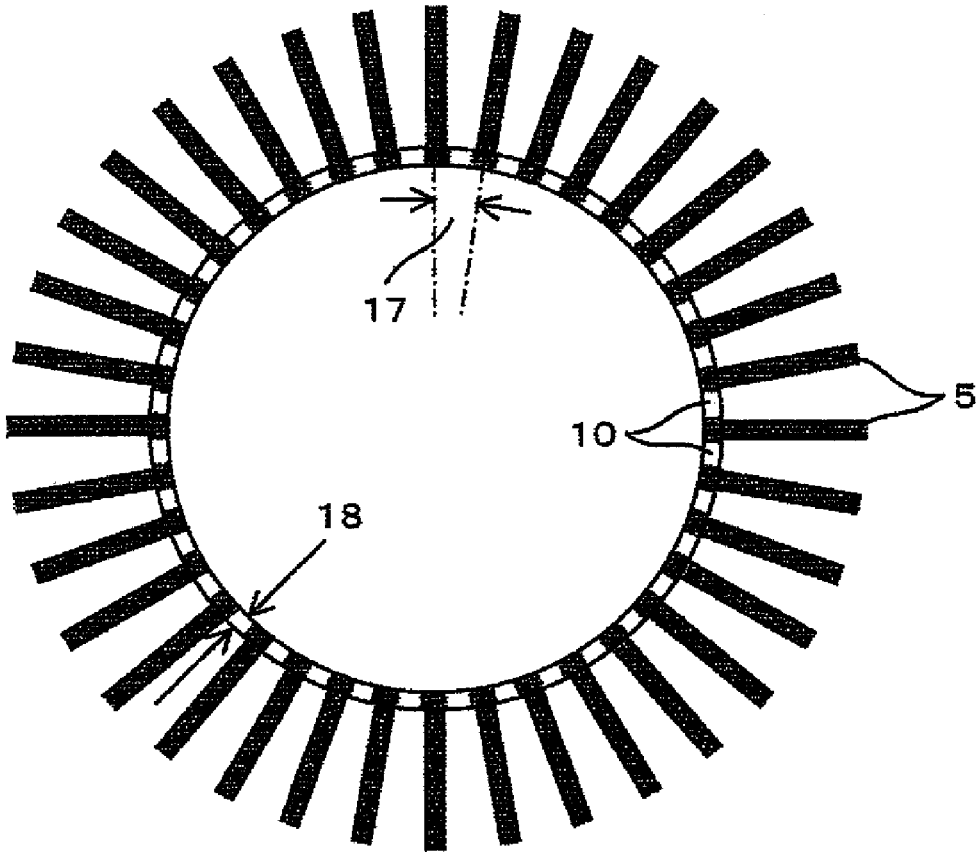
FIGS. 5A, 5B, and 5C are cross-sectional views of the first embodiment of the fluid mixture respectively taken along line VA-VA, VB-VB and VC-VC in FIG. 4 and showing fluids flowing state.
Figure 5B:
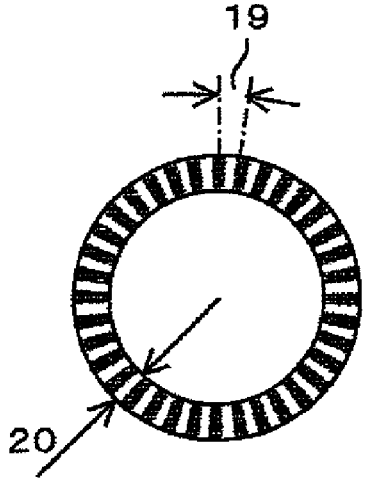
Figure 5C:
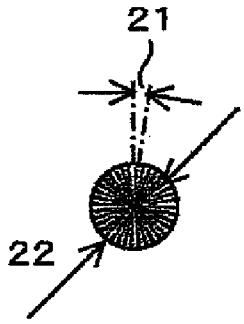

As shown in FIG. 5A, at the joining part 40, the first and second fluids are alternately placed on the circumference of the cylindrical component 2 in a manner corresponding to the number of the radially extending passages of the second supplying flow path 5. Mixing time by dispersion is determined by an inter-fluid distance 17 being a characteristic length in a dispersion direction. Therefore, as is apparent from FIGS. 5B and 5C, it is made possible to shorten the mixing time by decreasing the inter-fluid distances 19 and 21 in the mixing flow path 11. Moreover, the dispersion mixing time is proportional to the square of the distance, and therefore, if the inter-fluid distance become one half (½), the mixing time is considered to be about a quarter (¼). In order to shorten the mixing time by one-tenth (1/10) or more, it is preferable that the diameter of the discharge flow path 9 is reduced to about one-third (⅓) or less (mixing time: one-ninth (1/9)) relative to the diameter of the cylindrical section 51 of the cylindrical component 2 in the joining part 40 of the first and second supplying flow paths 10 and 5. In addition, as shown in FIG. 4, preferably, a cross sectional area of the mixing flow path 11 is gradually widened from the joining part 40 to the discharge flow path 9. Alternatively, though not shown, the cross sectional area of the mixing flow path 11 may be approximately constant between the joining part 40 and the discharge flow path 9. With these structures of the mixing flow path 11, an average flow rate at any positions in the mixing flow path 11 becomes gradually small or becomes approximately constant, whereby the flow becomes smooth and clogging of the mixing path 11 is not liable to occur.

With respect to clogging, a minimum dimension portion in a mixing flow path is critical when the fluid contains particles or is producing particles. In the first embodiment, the minimum dimension portion in the mixing flow path 11 is gradually expanded towards downstream (18 in FIG. 5A, 20 in FIG. 5B and 22 in FIG. 5C) and there is no throat portion in the mixing flow path 11. With this structure, it is possible to prevent occurrence of clogging of the mixing flow path 11 by solid particles.

In order to obtain the rapid mixing effect of fluids, it is important to equally arrange the first and second fluids just after their joining on the circumference of the joining portion 40 as shown in FIG. 5A. To achieve this equal arrangement of the fluids without being influenced by flow rates of the fluids, the minimum dimension portion 18 of the mixing flow path 11 (distance between the introducing component 1 and the cylindrical section 51 of the cylindrical component 2) in the joining part 40 and in the section taken along the line VA-VA in FIG. 4 is equal to or smaller than the width of each of the radially extending passages of the second supplying flow path 5 and the minimum dimension portion 18 has an approximately constant width over the whole circumference. Furthermore, as described above, in order to shorten the mixing time more to obtain smooth flow in the mixing flow path 11, the diameter of the cylindrical section 51 of the cylindrical component 2 in the joining part 40 is made larger than the diameter of the discharge flow path 9 and the cross sectional area of the mixing flow path 11 is made constant or is made gradually expanded towards downstream of the fluids. Therefore, it is necessary to make the minimum dimension portion 18 in the cross section taken along line VA-VA small as much as possible relative to the diameter of the cylindrical section 51 of the cylindrical component 2. In order to easily realize this, as shown in the first embodiment, a method is employed in which a clearance is formed by the difference in diameter between an internal diameter of the bore of the introducing component 1 and an external diameter of the cylindrical component 2. By employing this method, an annular flow path can be formed accurately in which the difference in diameter between the bore of the introducing component 1 and the cylindrical component 2 and the central axis of the introducing component 1 coincides with that of the cylindrical component 2. Also, a surface area of the first introducing flow path 4 can be increased by the annular flow path being thus formed, and therefore, the efficiency of the temperature control of the fluid can be improved.

Also, in a reaction to produce particles, there is a case in which particles gradually accumulate on the inner wall surface of the mixing flow path 11 due to long time operation. In this case, possibility of occurrence of clogging in the mixing flow path 11 can be inspected by monitoring pressure to be applied for the supply of the fluid and the like. However, according to the first embodiment, the cylindrical component 2 can be easily removed by handling the cylinder retainer 14 and the fixing screw 15, and therefore, it becomes possible to open the mixing flow path 11. This enables easy work for checking the state of the mixing flow path 11 and its easy maintenance.

Materials making up the above configuration are allowed to be selected from various metals such as highly corrosion resistant stainless in particular, corrosion-resistant nickel alloy, crystalline material such as glass, and plastic such as a fluorine resin or polyether ketone, depending on property, corrosiveness, exothermicity of reactions of the target row material.

According to the first embodiment, in the joining part of two ultra-thin annular flow paths, multilayer streams are formed in which two fluids are alternately placed in the circumference direction of the cylindrical component 2. This multilayer stream, due to contraction of the length of the circumference occurring when the stream flows through the conical mixing flow path, reduces a characteristic length of the dispersion mixing, which provides high mixing property. The distance between the inner and outer surfaces being the minimum interval of the conical flow path becomes gradually larger and, there is no throat portion, which enables the suppression of the clogging caused by produced particles.

Since, before mixing, annular flow having a uniform and thin pattern is formed and a surface area of a flow path is increased, controllability of temperature is enhanced. Moreover, owing to uniform flow of the fluid through a narrow flow path, neither local backflow nor stagnation occurs before and after the joining part, which prevents the clogging in the flow path.

The inside of the mixing flow path can be easily checked and cleaned by detaching the cylindrical component, which forms an inner face of the flow path, toward its upstream side.

By these effects, it becomes possible to conduct the efficient and high quality synthesis of particles.

Figure 6:
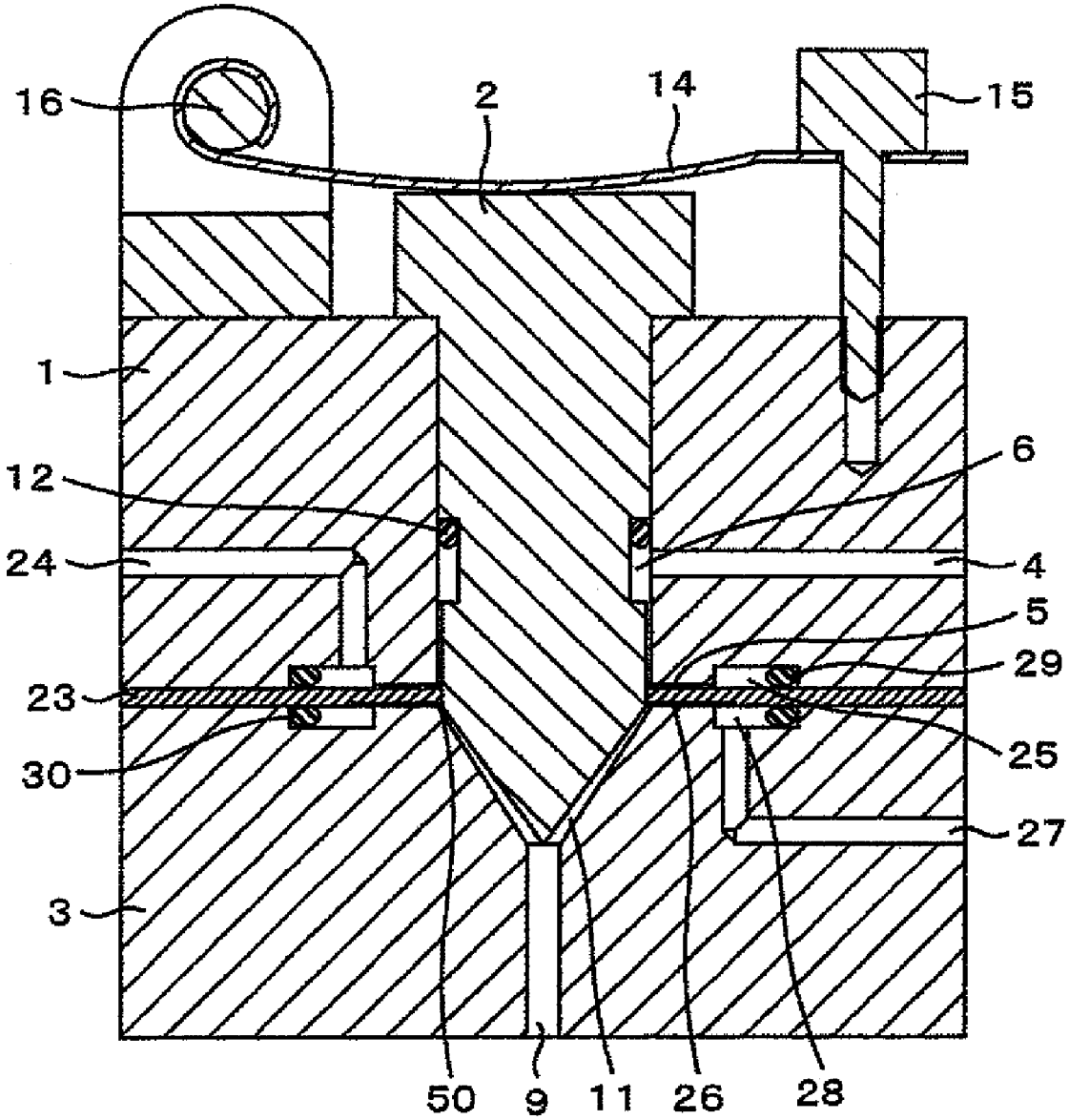
FIG. 6 is a cross sectional view of a second embodiment of the fluid mixer according to the present invention.

A second embodiment of the fluid mixer will be described with reference to FIG. 6.

The second embodiment of the fluid mixer has a structure in which an introducing component plate 23 is added between the introducing component 1 and the mixing component 3 of the first embodiment.

The introducing component 1 is provided with a first introducing flow path 4, a second introducing flow path 24, a second distributing flow path 25 and a second supplying flow path 5. The second distributing flow path 25 comprises an annular recess formed around the bore of the introducing component 1. The second introducing flow path 24 is communicated with the second distributing flow path 25. The cylindrical component 2 is provided with a first distributing flow path 6. The introducing component plate 23 is provided with a third supplying flow path 26. Similar to the second supplying flow path 5, the third supplying flow path 26 comprises a plurality of radially extending flow passages outlets of which are opened in the bore of the introducing component 1 and inlets of which are opened in a third distributing flow path 28 described later. Accompanying with the addition of the introducing component plate 23, the mixing component 3 is provided with a third introducing flow path 27, the third distributing flow path 28 communicated with the third introducing flow path 27, and the discharge flow path 9.

The introducing component plate 23 is formed with a circular hole having the same diameter as that of the bore of the introducing component 1. The introducing component plate 23 is fixed to the introducing component 1 and the mixing component 3 by means of positioning pins etc. (not shown) so that a central axis of the circular hole coincides with that of the cylindrical component 2, and the cylindrical component 2 extends into the circular hole. The second distributing flow path 25 and third distributing flow path 28 are annular flow paths and distribute the second and third fluids so that the first, second, and third fluids have approximately the same fluid width. The second and third distributing flow paths 25 and 28 distribute the second and third fluids so that the first, second, and third fluids have the same numbers of widths of fluids.

According to the second embodiment, when the first, second, and third fluids are mixed in a joining part 50, rapid mixing is achieved by equally arranging three fluids on a circumference of the joining part 50 and by contracting these fluids toward the center axis.

Figure 7:
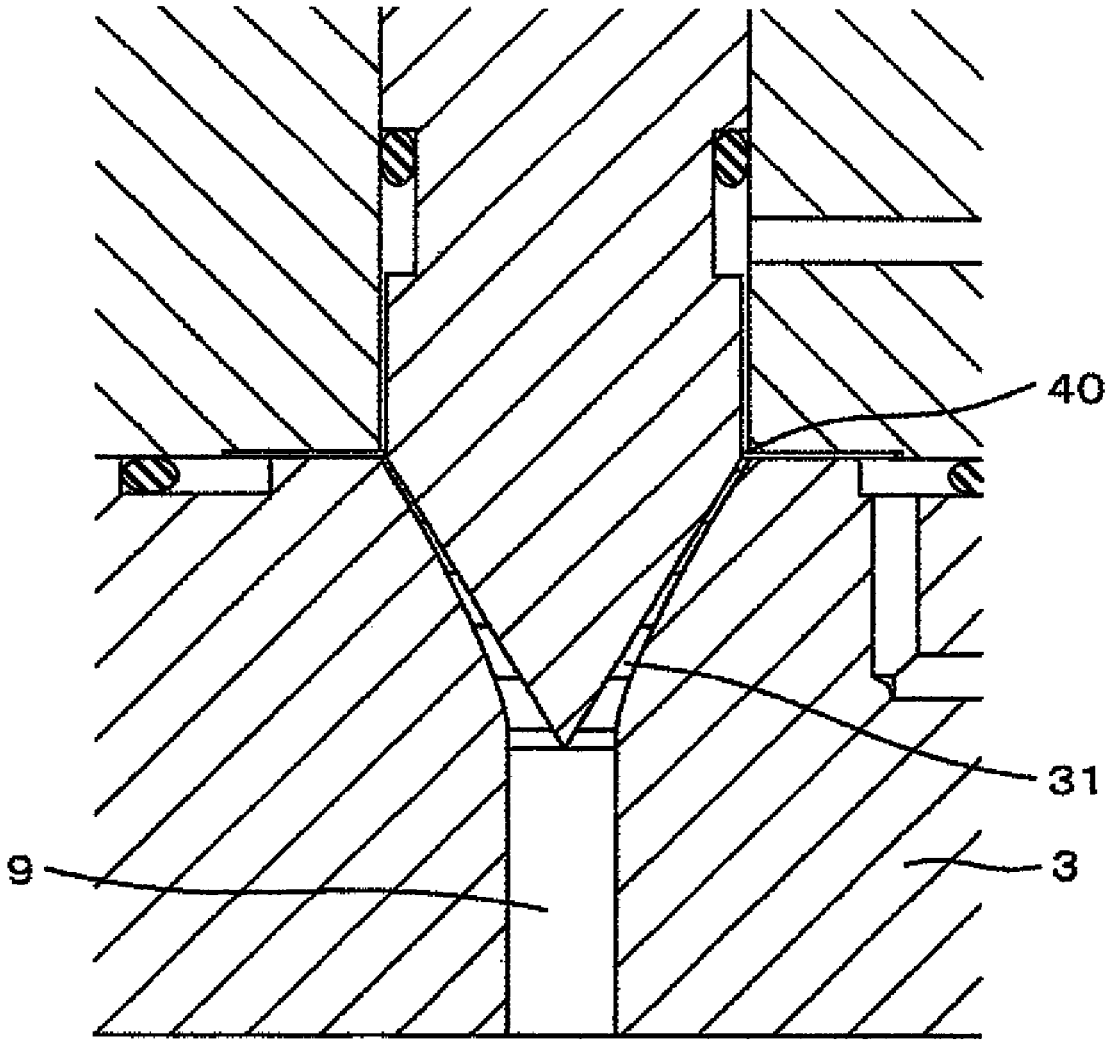
FIG. 7 is a cross sectional view of a main part of a third embodiment of the fluid mixer according to the present invention.

A third embodiment of the fluid mixer will be described with reference to FIG. 7.

The third embodiment differs from the first embodiment in shape of the mixing flow path. In the third embodiment, a mixing flow path 31 is constructed so that a cross sectional area of the mixing flow path 31 in a horizontal direction (approximately perpendicular to a gravity direction) is approximately constant from the joining part 40 to the discharge flow path 9.

By the configuration in the third embodiment, an average flow rate becomes constant in every cross section of the mixing flow path 31, which can reduce the possibility of the occurrence of stagnation in the mixing flow path 31 and concentration of force of the fluids mixed locally. As a result, reaction between fluids becomes stable and particles being produced therein are liable to become constant in size. Further, it becomes possible to prevent that the produced particles adhere to the mixing flow path 11 and discharge flow path 9 to clog them.

It goes without saying that the structure can be applied to the second embodiment of the fluid mixer and similar effects can be obtained.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A fluid mixer for mixing a first fluid and a second fluid and comprising: an introducing component having a bore; a cylindrical component fitted into the bore of said introducing component and comprising a cylindrical section and a conical section projecting from a bottom of the cylindrical section; and a mixing component having a conical recess and on which said introducing component and said cylindrical component are held, said fluid mixer further comprising:

a first introducing flow path for receiving the first fluid;

a first distributing flow path for distributing the first fluid introduced from said first introducing flow path over the whole circumference of said cylindrical component;

a second introducing flow path for receiving the second fluid;

a second distributing flow path of an annular shape concentric with said cylindrical component and for distributing the second fluid introduced from said second introducing flow path so that the first fluid and the second fluid are alternately arranged in an circumferential direction;

a joining part for joining together the first fluid fed from said first distributing flow path and the second fluid fed from said second distributing flow path with the first fluid and the second fluid alternately arranged in said circumferential direction;

a mixing flow path formed between said conical section of said cylindrical component and said conical recess of said mixing component for mixing the first and second fluids, the cross sectional area of said mixing flow path in a direction perpendicular to the gravity direction being constant or increasing in the flow direction; and a discharge flow path for discharging mixed fluid of the first and second fluids fed from said mixing flow path.

2. The fluid mixer according to claim 1, wherein, said first introducing flow path is provided in said introducing component, said first distributing flow path is provided in said cylindrical component, and said second introducing flow path, said joining part, said mixing flow path and said discharge flow path are provided in said mixing component.

3. The fluid mixer according to claim 1, wherein said second distributing flow path is configured to distribute the second fluid so that the width of the second fluid becomes the same as that of the first fluid.

4. The fluid mixer according to claim 1, wherein a cross sectional area of said joining part in a direction perpendicular to the gravity direction is substantially equal to that of said discharge flow path.

5. The fluid mixer according to claim 2, wherein said cylindrical component is provided with a first supplying flow path for said first fluid the diameter of a portion of said cylindrical component in which said first supplying flow path is provided is greater than the diameter of a portion of said cylindrical component in which said first distributing flow path is provided.

6. The fluid mixer according to claim 2, further comprising an introducing component plate provided between said introducing component and said mixing component, wherein said mixing component is provided with a third introducing flow path for a third fluid and a third distributing flow path for distributing the third fluid introduced from said third introducing flow path and wherein the introducing component plate is formed with a third supplying flow path comprising a plurality of radially extending flow passages having outlets to the bore of the introducing component and inlets in the third distributing flow path.

7. The fluid mixer according to claim 5, wherein said second distributing flow path and said third distributing flow path are configured to distribute the second fluid and the third fluid so that the first fluid, the second fluid and the third fluid have the same width.

* * * * *